US007448827B2

(12) United States Patent
Li

(10) Patent No.: US 7,448,827 B2
(45) Date of Patent: Nov. 11, 2008

(54) TRUSSED EMBANKMENT DAM AND WALL STRUCTURE

(76) Inventor: Piao-Chin Li, No. 18, 2nd Neighborhood, Jinshih Village, Sihu Township, MiaoLi County 368 (TW)

( * ) Notice: Subject to any disclaimer, the term of this patent is extended or adjusted under 35 U.S.C. 154(b) by 195 days.

(21) Appl. No.: 11/396,703

(22) Filed: Apr. 4, 2006

(65) Prior Publication Data

US 2006/0257209 A1 Nov. 16, 2006

(30) Foreign Application Priority Data

May 13, 2005 (TW) ..... 94115608

(51) Int. Cl.
*E02B 7/14* (2006.01)

(52) U.S. Cl. ..... 405/110; 405/114; 405/116; 405/273; 405/284; 52/652.1; 52/655.1

(58) Field of Classification Search ..... 405/223.8, 405/223.9, 223.11, 110, 114, 116, 272, 282, 405/284; 52/652.1, 655.1, 656.2, 633, 637, 52/638

See application file for complete search history.

(56) References Cited

U.S. PATENT DOCUMENTS 2,709,318 A * 5/1955 Benjamin ..... 446/103
3,864,049 A * 2/1975 Ono ..... 403/171
5,074,094 A * 12/1991 Gassler ..... 52/655.2
5,305,571 A * 4/1994 Trevino ..... 52/653.2
5,427,472 A * 6/1995 Ono ..... 405/29
6,234,715 B1 * 5/2001 Ono ..... 405/29

* cited by examiner

*Primary Examiner*—Tara L. Mayo
(74) *Attorney, Agent, or Firm*—Rosenberg, Klein & Lee

(57) ABSTRACT

A trussed embankment dam and wall structure includes a cantilever structure group and a rod member group, and each cantilever structure of the cantilever structure group includes an anchor supporting pillar and a multidirectional connecting board. The lower portion of the anchor supporting pillar is built at a stratum or foundation to support the cantilever structure, and the upper portion of the anchor supporting pillar installs a multidirectional connecting board to a trussed joint structure. After a force is exerted to a rod member of the invention, the force is acted onto the joints of the cantilever structure and transmitted by other rod members. Therefore, each cantilever structure maximizes the supporting effect and provides a dispersive supporting type structure. Unlike the centralized supporting type truss structure, the invention uses the hollow portion of the structure and the malleability of components to create landscapes, fill soil and plant vegetation.

9 Claims, 11 Drawing Sheets

TRUSSED EMBANKMENT DAM AND WALL STRUCTURE

BACKGROUND OF THE INVENTION

1. Field of the Invention

The invention relates to a trussed embankment dam and wall structure, and more particularly to an embankment dam and wall structure that uses the concept of a truss to build a dam and wall structure for filling soil, planting vegetation, exchanging species and habitat, and creating beautiful spatial landscape.

2. Description of the Related Art

Cantilever type or gravity type structures are wall and embankment dam structures commonly used in civil engineering. The gravity type structure uses its own weight to support a toppling torque and a horizontal thrust produced by external forces. The cantilever type structure uses the characteristics of a cantilever to resist the toppling torque caused by external forces as well as the total weight of the structure and the friction produced by the backfill weight at the foundation to resist the horizontal thrust produced by external forces. As to mechanics, both of these structures are planar structures, and they have the following features. Firstly, they come with a single function of safety and maintenance only, and have no other functions. Secondly, their physical planes and landscapes are monotonic, and the wall structure is basically a level surface, and thus giving a poor landscape. Even if these structures are made by using stylish moldboards, the landscape still cannot be improved significantly. Thirdly, these two structures adopt a cast-in-place process to assemble steel bars and moldboards and cast concretes at the spot, and thus the construction schedule may be delayed by climates easily. Fourthly, these structures produce an isolating effect, and the wall structure blocks the route of species. The higher the structure, the more significant is the isolating effect. Fifthly, these structures cannot be maintained or repaired easily, and if a portion of the wall structure or foundation is damaged, it will be difficult to find a good way to fully fix the damaged portion. Sixthly, these structures cannot be used for emergency uses, and thus it is impossible to use these structures as emergency protective measures.

The technological trend of developing an embankment dam and wall structure tends to be multidirectional, and the same structure can be multifunctional for different applications. The present common cantilever type or gravity type embankment and wall structure have taken safety and maintenance into consideration for their design and seldom include other applications and purposes. As a result, the present structures come with a single application only and a monotonic planar landscape, and the insolating effect blocks the route of species movements and makes the species exchange difficult. Since these structures can be built with a cast-in-place process and certain materials, the structures of this sort cannot be used for emergency.

SUMMARY OF THE INVENTION

In view of the shortcomings of the prior art, the inventor of the present invention based on years of experience to conduct extensive researches and experiments to overcome the foregoing shortcomings, and finally invented a trussed embanking dam and wall structure in accordance with the present invention.

Therefore, it is a primary objective of the present invention to provide a trussed embankment dam and wall structure to overcome the shortcomings of the traditional cantilever type or gravity type wall and embankment dam structures that have a single function, a monotonic landscape, a long and complicated construction period, and a difficult maintenance and repair. The invention is designed with a multidirectional structure and developed for multifunctional purposes and applications, not only achieving the effects for safety and maintenance, but also improving the environment, enhancing the landscape, and facilitating the ecological development.

In the trussed embankment dam and wall structure of the present invention, each cantilever structure of the cantilever structure group includes an anchor supporting pillar and a multidirectional connecting board. The anchor supporting pillar forms a support to the cantilever structure by anchoring the lower portion of the anchor supporting pillar onto a stratum or a foundation and assembles the multidirectional connecting board onto the upper portion of the anchor supporting pillar. Both ends of any one rod member of the rod member are coupled integrally to a joint to define a hinge effect. Each cantilever structure is a structure concurrently having the support and joint effects, and each rod member of the rod member group acts as a rod member of a truss structure and connects to each joint of the cantilever structure, so as to maximize the supporting function of the truss structure. However, it is worth pointing out that the trussed embankment dam and wall structure of the invention differs from the general truss structure as follows:

Firstly, the general truss structure uses a joint as a force exerting point to transmit and disperse the force through the rod member and the force is finally transmitted to the supporting structure of the truss structure and guided into the stratum. In this process, each joint is not related directly to the rod member and the support of the structure, but each joint of the trussed embankment dam and wall structure is disposed directly on the cantilever structure. Meanwhile, each cantilever structure concurrently provides a supporting effect, and the rod member is coupled to each joint, and thus each joint and each rod member of this structure are related. In other words, the centralized supporting type truss structure is converted into a dispersive supporting type truss structure.

Secondly, the rod member of the general truss structure is an axial rod member. In addition to other secondary effects, the moment and shear will not be taken into consideration. The rod members of this structure are divided into two types: one type of rod members supports the action of external forces at the joint, and the other type of rod members such as the rod member of a general truss structure treats the rod member as an external component of the structure, and the joint serves as a support or a medium for transmitting external forces.

The cantilever structure group and the rod member group will be described below. Each cantilever structure of the cantilever structure group includes an anchor supporting pillar and a multidirectional connecting board. The anchor supporting pillar forms a support to the cantilever structure by anchoring the lower portion of the anchor supporting pillar onto a stratum or a foundation and assembles the multidirectional connecting board onto the upper portion of the anchor supporting pillar. Both ends of any one rod member of the rod member are coupled integrally to a joint to define a hinge effect. A hinge joint formed between a cantilever structure and a rod member must be able to bear the tensile and compressive stresses, and the portion that bears the tensile and compressive stresses is provided by the compressive resistance of the materials of the connecting board and the anchor supporting pillar. The compressed portion also involves a connecting member installed between the joint and the rod member. Regardless of the joint being pulled or compressed, a shear is exerted onto the connecting member, and the shear effect will produce a tensile and compressive effect in the multidirectional connecting board, and the action is transmitted to the anchor supporting pillar. In summation of the above description, the anchor supporting pillar mainly bears the moment and shear. To maximize the hinge effect of each cantilever structure, an appropriate material should be adopted for making each component according to the force exerting property of each component. For example, the steels in reinforced concretes is used for manufacturing the multidirectional connecting board, so that the compressive portion is supported by the reinforced concrete, and the tensile portion is supported by the steel, and this principle may apply to other components as well. It is worth pointing out an important issue that the depth for installing the anchor supporting pillar into the supporting stratum is adjusted according to the geological nature of the stratum. If the anchor supporting pillar is buried into the foundation, a secured anchor is needed, so that a certain component can be used for connecting the pillar with the foundation. There is no particular limitation for components, and any component that features a good latching effect and an easy installation can be used.

In the rod member group, both ends of each rod member are connected to the joint by a connecting member, or an embedding structure corresponding to an end of the rod is wedged with the multidirectional connecting board to define a hinge effect, and such hinge connection provides a support at the edge of each rod member. In the whole structure, the rod member is divided into two types: one type is to introduce external force into the joint and the other type is to transmit forces between the joints. Therefore, the structure is analyzed by means of two hinged beams and an axial rod member. Like the joint, the materials used for making the structure are chosen according to their capability of receiving forces. For example, an arched girder structure adopts reinforced concretes or steels, and the axial rod member uses the foregoing materials according to different tensile and compressive stresses. Overall speaking, the type of force exerted on the cantilever structure or its components is affected directly by the overall layout of the structure, and thus it is a priority to have a perfect analysis for the structure and layout, so as to achieve a cost-effective and quick construction.

Further, several cantilever structures of the cantilever structure group can be combined to form a subgroup, and such subgroup can be considered as an independent cantilever structure. In other words, the whole structure can be divided into subgroups, and each subgroup can resist forces independently. The rod members can be connected in a subgroup for transmitting and dispersing forces. For example, three cantilever structures are bound into a subgroup, and the rod member in a rod member group can use other rod members to combine two or more rod members, so as to achieve a good force transmitting effect. Further, the whole structure can add an accessory equipment to enhance the reinforcing effect of the structure. For example, the force is introduced to the rear of the rod member of the joint, and a tire net is laid and connected to the rod member, and then the tire net is filled and covered with soil, so that an obstructing effect is produced between the tire and the soil filling to share a portion of forces exerted onto the structure.

In the trussed embankment dam and wall structure of the present invention, modifications can be made for the foregoing basic architecture. For example, the supporting effect of the lower portion of the anchor supporting pillar of the cantilever structure group installed into the stratum can be substituted by the friction produced at the stratum by the weights of the subgroup and the filling soil, so that the lower portion of the anchor supporting pillar can be cancelled and its supporting effect can be replaced by the friction at the bottom of the structure. In the meantime, the connecting member can be divided and integrated directly with the rod member and then coupled to the multidirectional connecting board to act as a structure for the joint effect. In the whole structure, the upper portion of the anchor supporting pillar can be shortened, and the connection of the rod member and the multidirectional connecting board by the connecting member can be used to replace the shortened portion, or even the anchor supporting pillar can be cancelled by using the weights of the structure and filling soil as well as the connection of the connecting member, rod member and multidirectional connecting board to substitute the actions at the upper and lower portions of the anchor supporting pillar. The weights of the structure and the filling soil and the internal actions of the structure can achieve the same effect of a basic architecture.

The construction of the structure will be described as follows. Basically, the trussed embankment dam and wall structure is pre-cast oriented, and thus the first step is carry out the pre-cast according to the design pattern of the components of the structure and perform an accurate loft at the site according to the layout of the structure. The anchor supporting pillar is installed and then the multidirectional connecting board and rod member are assembled, or the multidirectional connecting board and the rod member at the bottom surface are assembled and then the anchor supporting pillar is installed, and the multidirectional connecting boards and rod members are assembled to the desired height, and the soil is filled layer by layer or after the structure is finished, and finally the vegetation is planted. It is worthy pointing out that the construction can be modified according to the conditions of the environment.

BRIEF DESCRIPTION OF THE FIGS.

DETAILED DESCRIPTION OF THE PREFERRED EMBODIMENT

Figure 1:
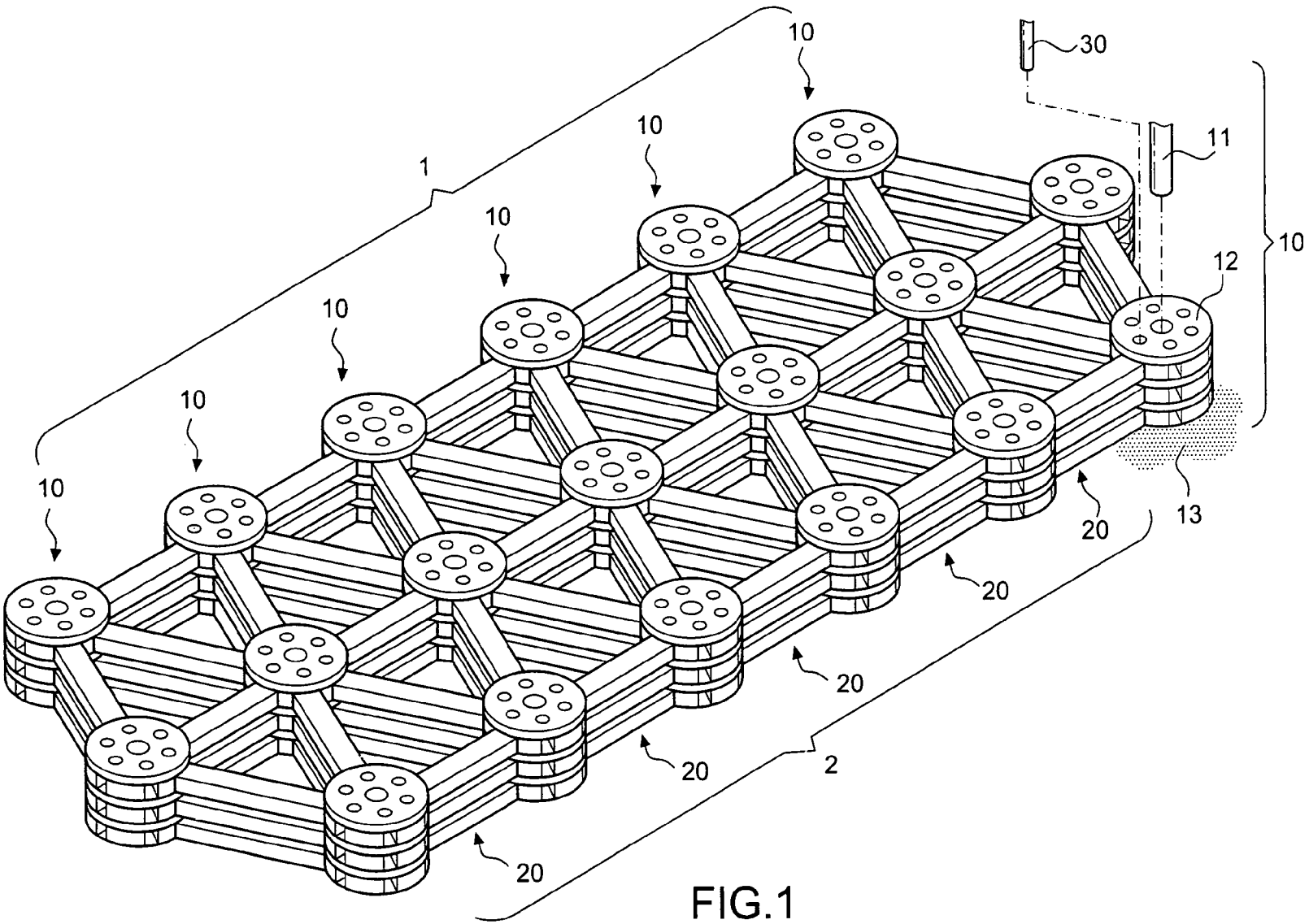
FIG. 1 is a perspective view of a first preferred embodiment of the invention.
Figure 2:
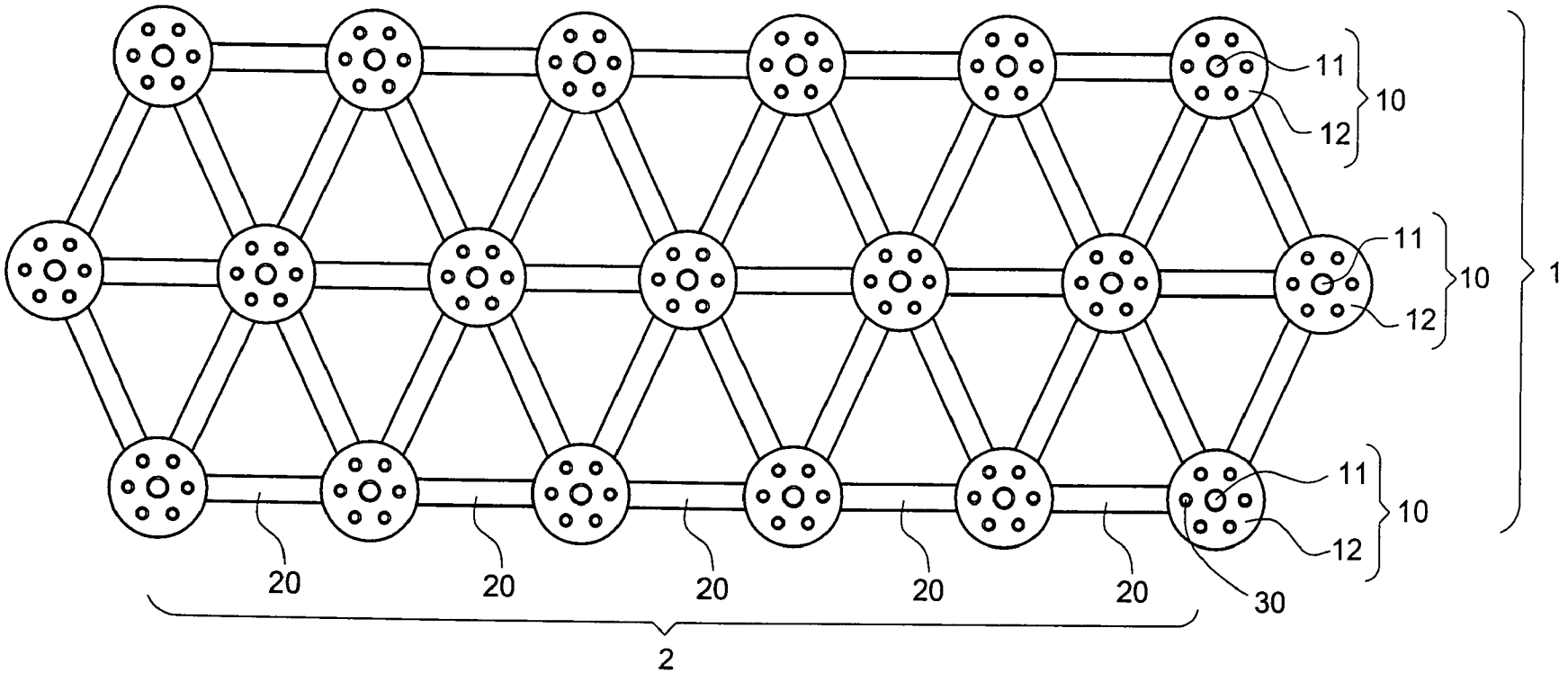
FIG. 2 is a top view of a first preferred embodiment of the invention.

Referring to FIGS. 1 and 2 for the perspective view and the top view of a trussed embankment dam and wall structure respectively, the structure comprises:

a cantilever structure group 1, and each cantilever structure 10 including an anchor supporting pillar 11 and a multidirectional connecting board 12, wherein the anchor supporting pillar 11 anchors its lower portion to a supporting stratum or foundation 13 to form a support for the cantilever structure, and the upper portion of the anchor supporting pillar 11 installs at least one multidirectional connecting board 12 to constitute a truss joint structure; and a rod member group 2 and both ends of any one of the rod members 20 being integrated with the joint by a connecting member 30 to define a hinge effect, such that the whole structure becomes a trussed embankment dam and wall structure.

Figure 3:
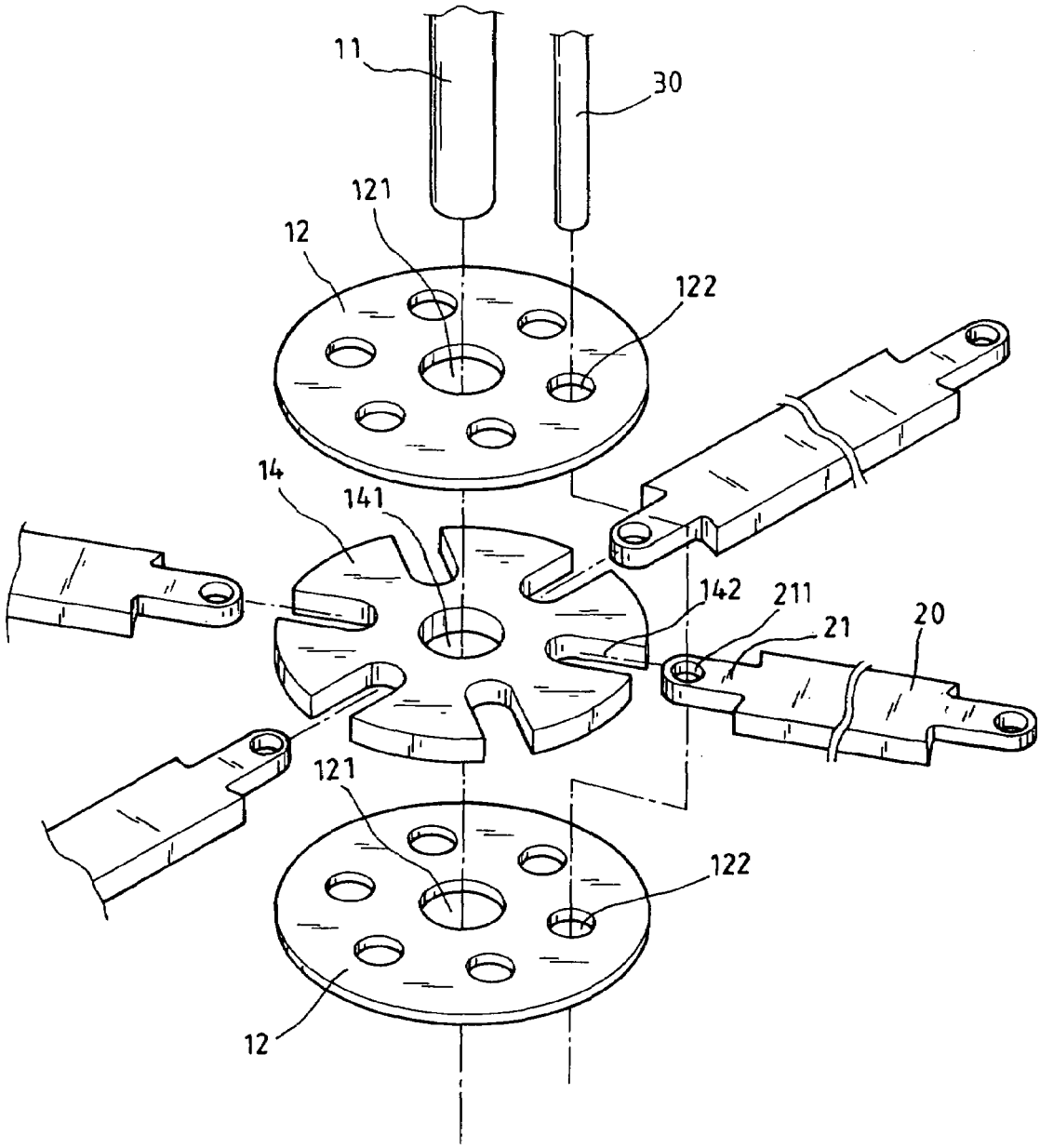
FIG. 3 is an exploded view of a joint structure of a first preferred embodiment of the invention.
Figure 4:
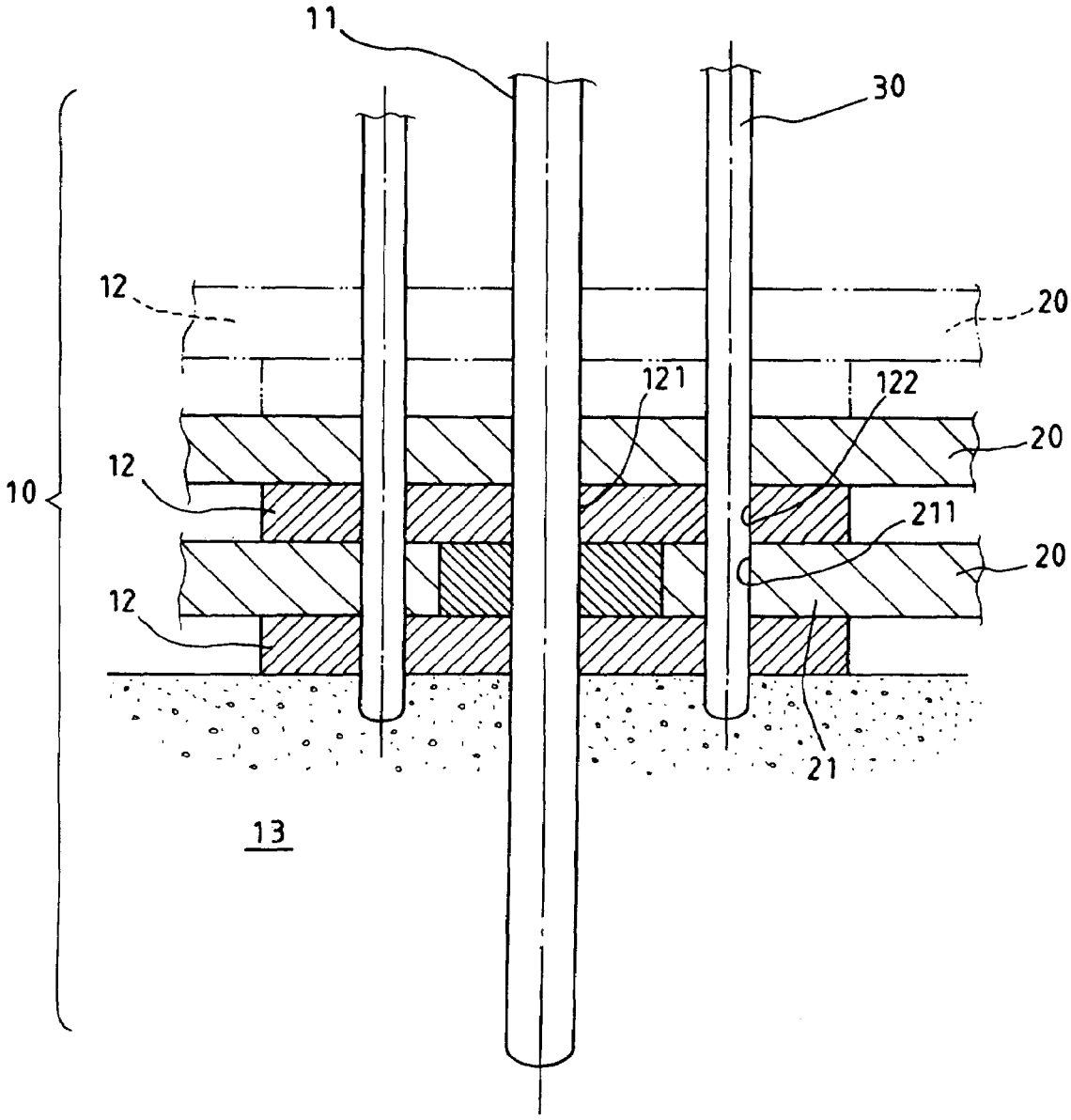
FIG. 4 is a cross-sectional view of a joint structure of a first preferred embodiment of the invention.

The cantilever structure group 1 and the rod member group 2 of the foregoing structure come with specific quantity and form, but not limited to those as described in this preferred embodiment. Referring to FIGS. 3 and 4 for a detailed description of the structure, the multidirectional connecting board 12 includes a first through hole 121 at its middle for passing and fixing the anchor supporting pillar 11, and the first through hole 121 includes a plurality of first connecting holes 122 at its periphery, and a linking board 14 disposed between two multidirectional connecting boards 12, and the middle of the linking board 14 has a second through hole 141, and the board includes a plurality of axial connecting grooves 142, and the opening of the connecting groove 142 faces outside for precisely receiving an end portion 21 of any one of the rod members 20, and the end portion 21 corresponding to a first connecting hole 122 includes a corresponding second connecting hole 211, so that the first connecting holes 122 and the second connecting hole 211 are integrally coupled by a connecting member 30 to define a hinge effect.

Figure 5:
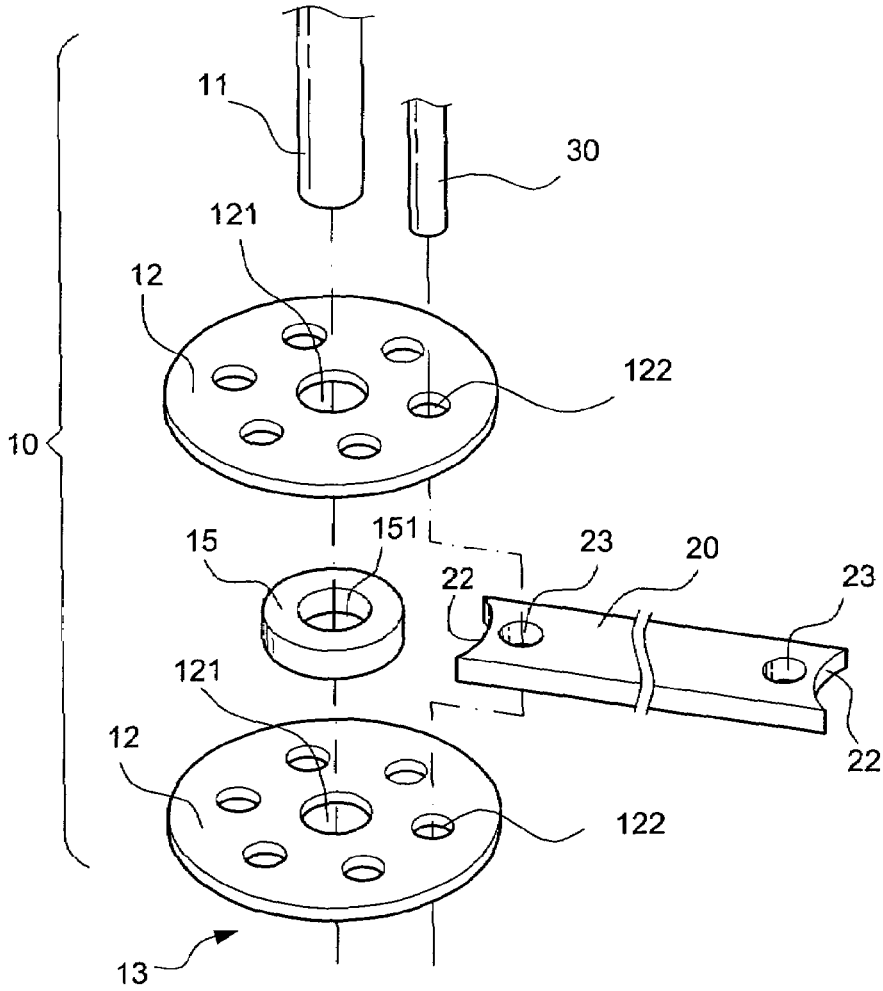
FIG. 5 is an exploded view of a joint structure of a second preferred embodiment of the invention.
Figure 6:
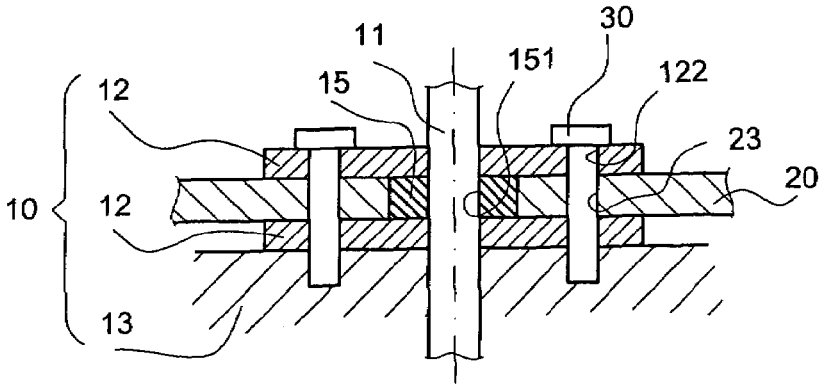
FIG. 6 is a cross-sectional view of a joint structure of a second preferred embodiment of the invention.

The foregoing linking board 14 in the joint structure is used for an effect including but not limited to diversifying force and pressure. Referring to FIGS. 5 and 6 for a second preferred embodiment of the joint structure of the present invention, the numerals are the same as those used in the first preferred embodiment, and the linking board 14 is substituted by a ring 15, and the middle of the ring 15 includes a third through hole 151 for passing the anchor supporting pillar 11, and the end portion 21 of the rod member 20 is extended to an edge of the ring 15 to form a concavely curved surface 22 according to its curvature, and an end portion of the rod member includes a third connecting hole 23 corresponding to the first connecting hole 122, so that the first connecting hole 122 and the third connecting hole 23 are integrally coupled by a connecting member 30 to define a hinge effect.

Figure 6A:
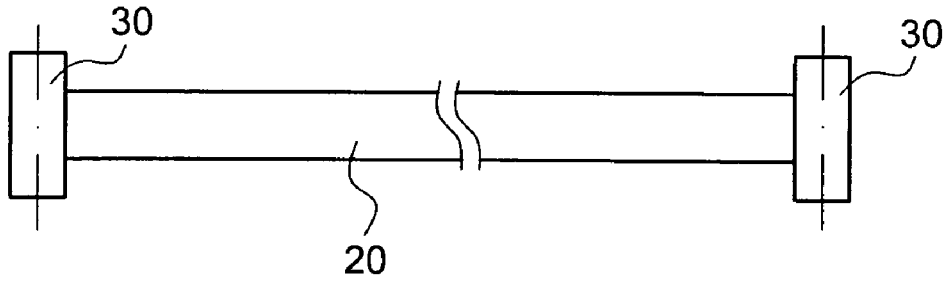
FIG. 6A is a schematic view of a connecting member and a rod member integrally coupled with each other according to a second preferred embodiment of the invention.
Figure 6B:
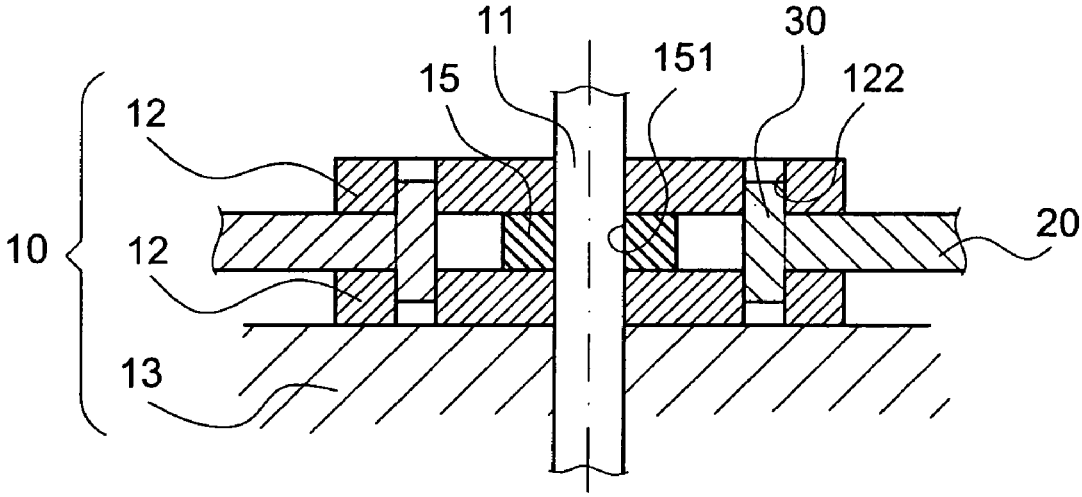
FIG. 6B is a cross-sectional view of a rod member and a multidirectional connecting board coupled with each other according to a second preferred embodiment of the invention.

Referring to FIGS. 6A and 6B, the present invention further integrates the rod member 20 and the connecting member 30, so that a predetermined length of the connecting member 30 is shaped with the rod member 20 to fix both ends of the rod member 20 and an end portion of the connecting member 30 is coupled directly to the first connecting holes 122 of the multidirectional connecting board 12 to define a hinge effect.

Figure 7:
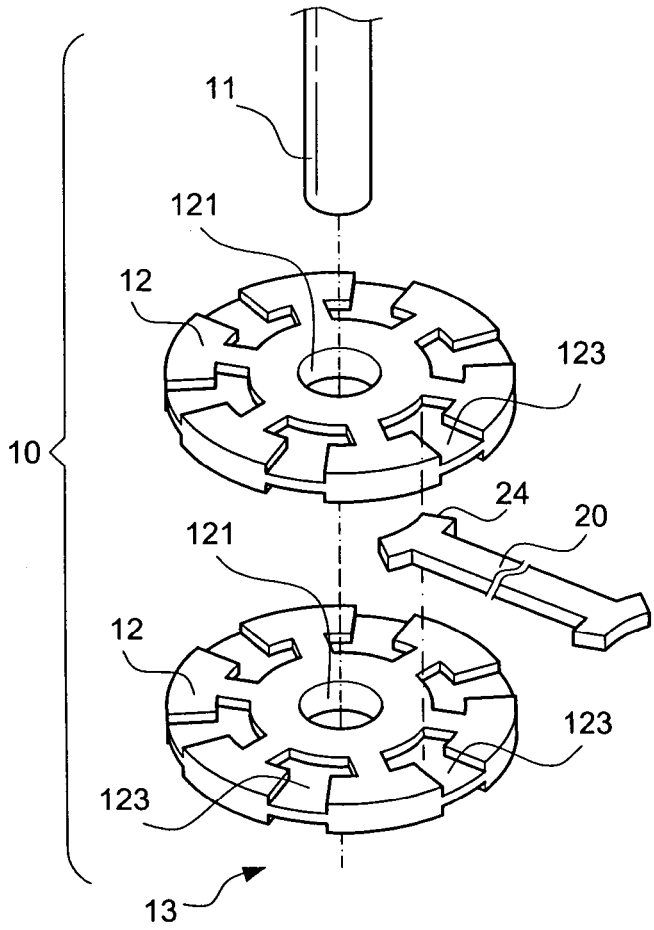
FIG. 7 is an exploded view of a joint structure of a third preferred embodiment of the invention.
Figure 9:
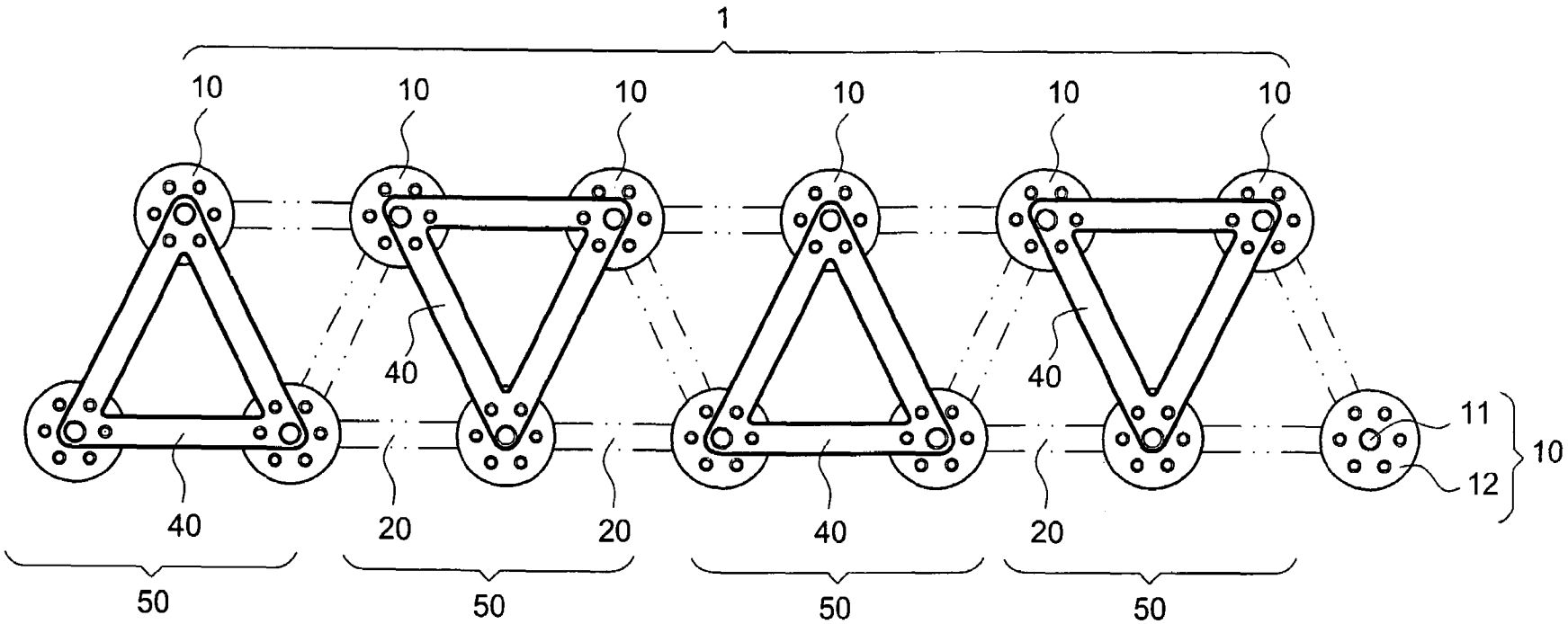
FIG. 9 is a schematic view of a fourth preferred embodiment of the invention.

Referring to FIGS. 7 and 9 for a third preferred embodiment of the joint structure of the present invention, the multidirectional connecting board 12 includes a plurality of latch grooves 123 with its openings facing outward and disposed at the periphery of the first through hole 121, and the latch grooves 123 are disposed on a lateral side or the top or bottom sides of the multidirectional connecting board 12. In this preferred embodiment, the latch grooves 123 are disposed on both top and bottom sides of the multidirectional connecting board 12, but the invention is not limited to such arrangement. The end portion 21 of the rod member 20 corresponding to the latch groove 123 can be the corresponding embedding members 24 for a wedging connection, so that the end portion 21 of the rod member 20 and the latch groove 123 can be integrally coupled to define a hinge effect. However, the latch groove 123 is not limited to a T-shape structure, and other embedding and wedging structures can be used instead, but these structures will not be described here.

Figure 8:
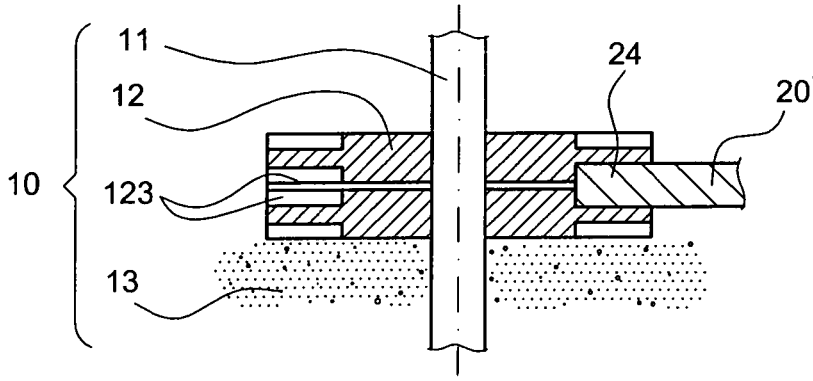
FIG. 8 is a cross-sectional view of a joint structure of a third preferred embodiment of the invention.
Figure 8A:
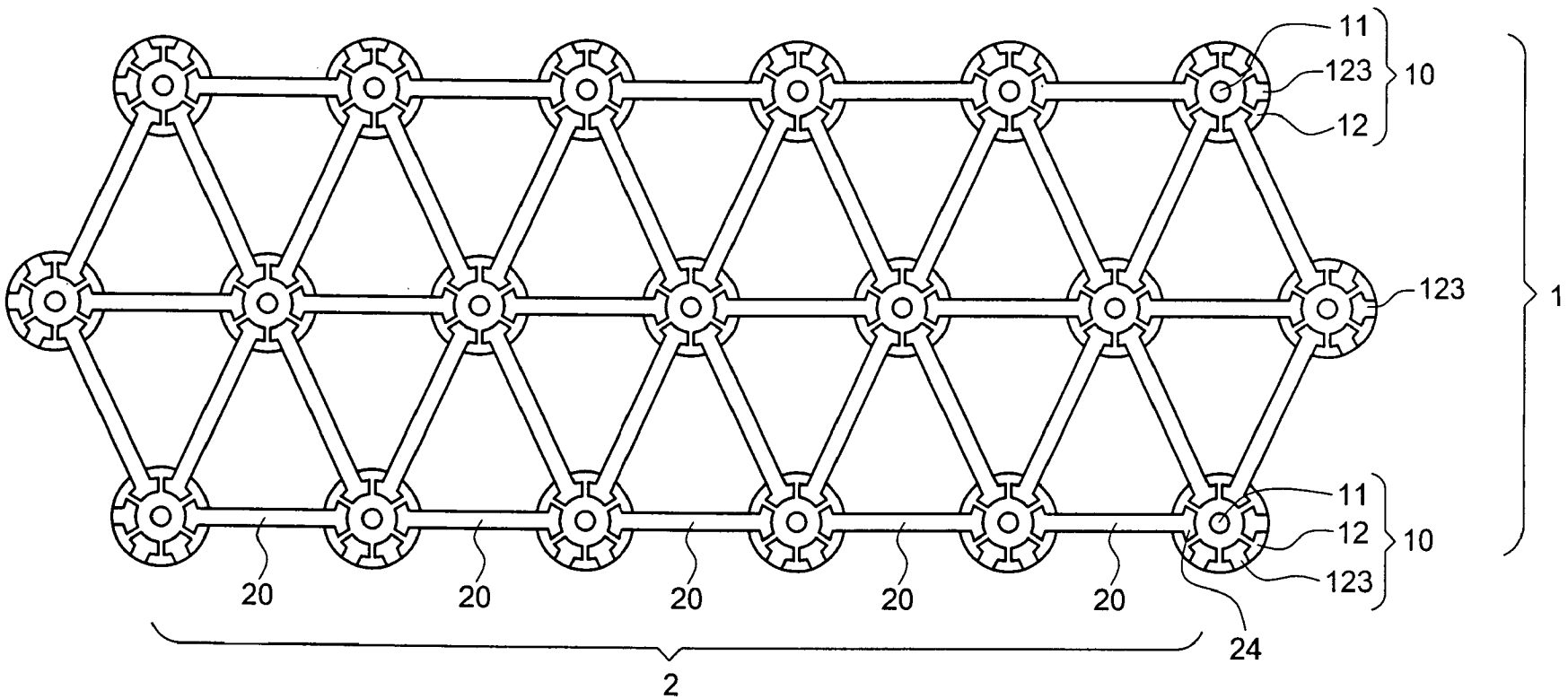
FIG. 8A is a schematic view of an application according to a third preferred embodiment of the invention.
Figure 8B:
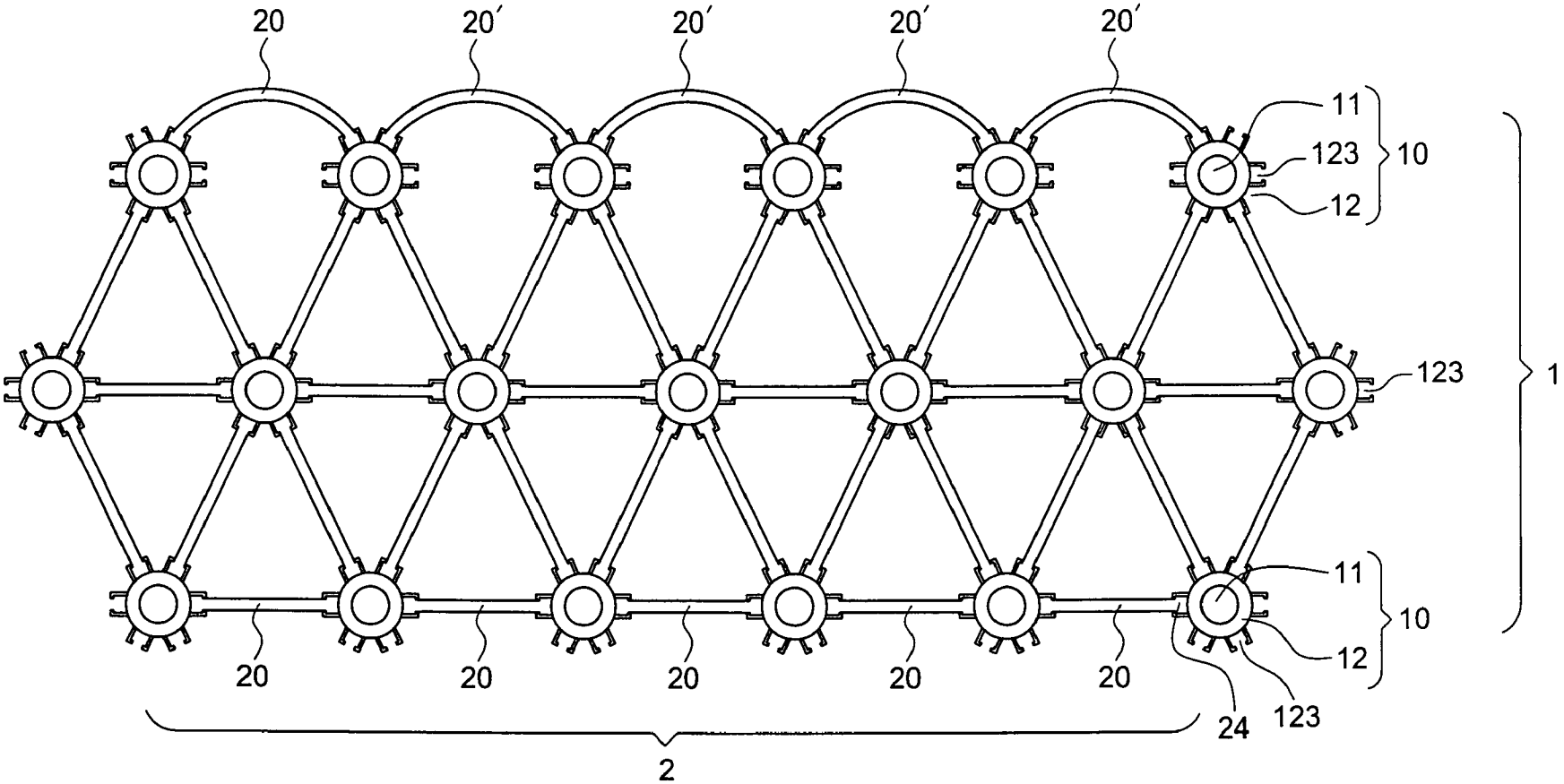
FIG. 8B is a schematic view of another application according to a third preferred embodiment of the invention.

Referring to FIG. 8A for an application of the preferred embodiment as shown in FIGS. 7 and 8, its structure and functions are similar to those illustrated in FIG. 2, and thus will not be described here. FIG. 8B shows another application, and its structure is substantially the same as the structure as illustrated in FIG. 8A, and the only difference resides on that the latch groove 123 is protruded from the periphery of the connecting board 12 to facilitate the curved design of the rod member 20'. Since its architecture and functions are the same as those illustrated in the previous preferred embodiments, and thus will not be described here.

Referring to FIG. 9 for the fourth preferred embodiment of the present invention, three or more cantilever structures 10 are contained in the cantilever structure group 1, and a triangular frame 40 is used to define a cantilever structure type subgroup 50, and each subgroup 50 is independent, or a rod member 20 can be used for connecting subgroups 50. Further, the present invention can add accessory equipments to enhance the strength for sharing forces exerted onto the structure, and such accessory equipments have been illustrated in the invention, and thus will not described again.

Besides the foregoing embodiments, the components of the invention can be modified to a certain extent according to the requirement of the external environment. For example, the upper portion of the anchor supporting pillar 11 can be shortened, and a connecting member 30 can be used for connecting the rod member 20 and the multidirectional connecting board 12 instead. For special environments, the lower portion of the anchor supporting pillar 11 can be cancelled, and the friction produced at the bottom of the construction with a sufficient weight of filling can be used as a substitute.

Figure 10:
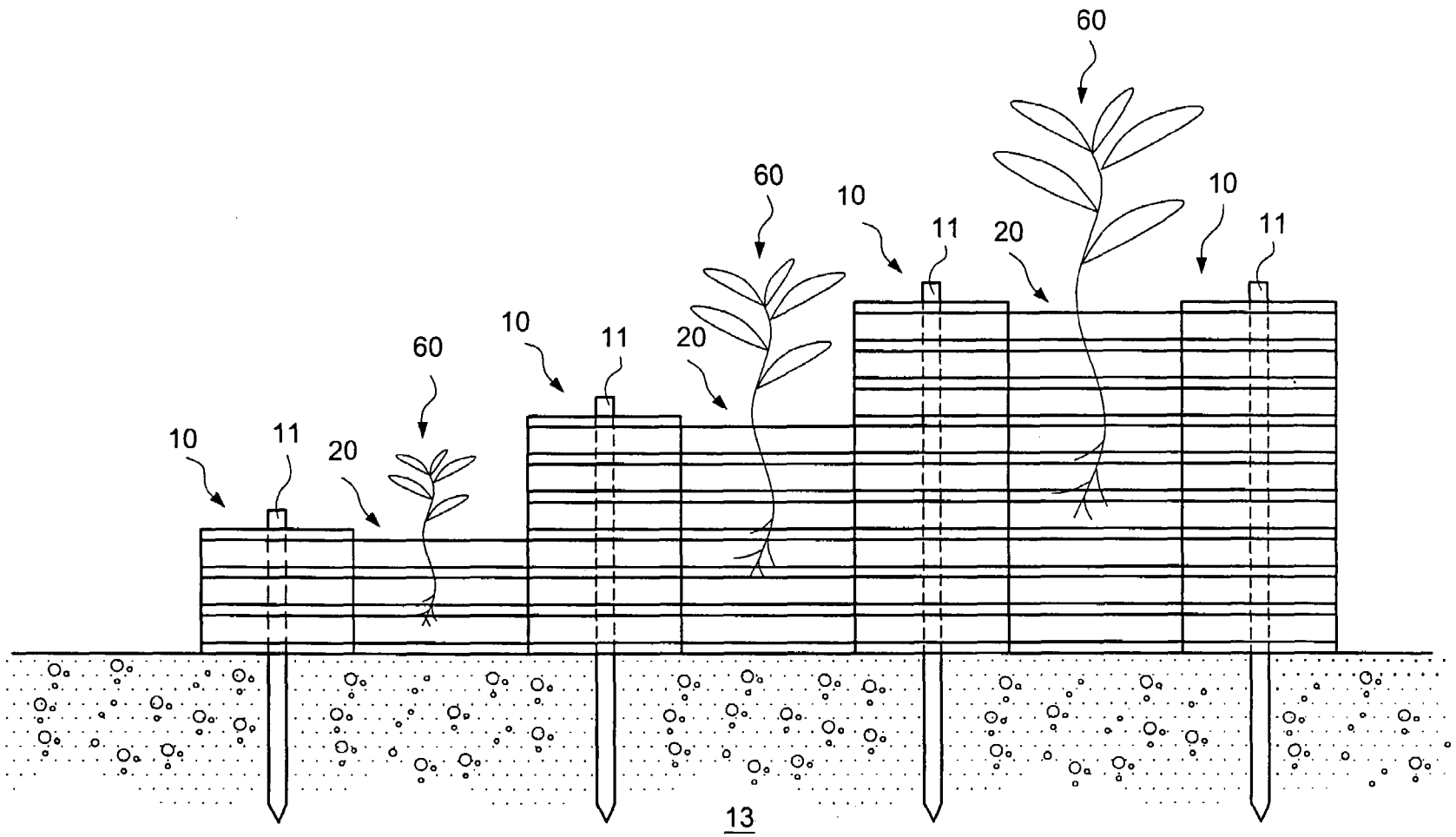
FIG. 10 is a schematic view of an application of the invention.

Referring to FIG. 10 for the schematic view of an application of the invention, each cantilever structure 10 of the cantilever structure group 1 can be installed according to the requirements of the embankment dam and wall structure, and each rod member 20 of the rod member group 2 has its malleability for creating a beautiful landscape to cope with the overall landscape, and the hollow portion of the structure can be used for filling soil and planting vegetation, so that the plants can beautify the landscape, regulate the climate, and facilitate the ecological development.

In addition, the present invention can effectively disperse external forces exerted on the structure and thus providing a reasonable durability and extending the life of its use. Furthermore, the overall structure can be pre-cast to make the construction more convenient and faster, and the structure can be used for emergency uses and quick maintenance and repair. The anchor supporting pillar 11 provides a duct effect, so that the structure can stand a higher settlement, and the botanical root system can be developed freely to enhance water and soil preservation.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A trussed embankment dam and wall structure, comprising a plurality of cantilever structures interconnected by a plurality of rod member groups to form a multiplicity of truss sections; each cantilever structure including at least one anchor member extending therefrom to form a support for the cantilever structure by anchoring a lower portion of the anchor member into a stratum or a foundation; each truss section being defined by three cantilever structures joined together by corresponding rod member groups to form a closed contour having a substantially triangularly shaped structure.

2. The trussed embankment dam and wall structure as recited in claim 1, wherein each cantilever structure includes at least two multidirectional connecting boards and at least one linking board disposed between the multidirectional connecting boards, each multidirectional connecting board having a centrally disposed first through hole for receiving an upper portion of the anchor member therein, the multidirectional connecting board having a plurality of first connecting holes formed through a peripheral portion thereof, the linking board having a centrally disposed second through hole formed therein and disposed in aligned relationship with the first through holes of the multidirectional connecting boards for passage of the anchor supporting pillar therethrough, the linking board having a plurality of axial connecting grooves formed therein, and each connecting groove having an outwardly facing opening for receiving an end portion of a respective rod member of a corresponding rod member group, the end portion of the respective rod member having a second connecting hole formed therethrough and disposed in correspondence with respective first connecting holes of the multidirectional connecting boards for receiving a connecting member to provide a pinned coupling thereof.

3. The trussed embankment dam and wall structure as recited in claim 1, wherein each cantilever structure includes at least two multidirectional connecting boards and at least one ring disposed between the multidirectional connecting boards, each multidirectional connecting board having a centrally disposed first through hole for receiving an upper portion of the anchor supporting pillar therein, the multidirectional connecting board having a plurality of first connecting holes formed through a peripheral portion thereof, the ring having a centrally disposed through hole formed therein and disposed in aligned relationship with the first through holes of the multidirectional connecting boards for passage of the anchor supporting pillar therethrough, an end portion of a respective rod member of a corresponding rod member group being disposed between the multidirectional connecting boards and extending to an outer periphery of the ring and the end portion of the respective rod member having a concavely curved surface corresponding to a curvature of the outer periphery of the ring, the end portion of the respective rod member having a connecting hole formed therethrough and disposed in correspondence with respective first connecting holes of the multidirectional connecting boards for receiving a connecting member to provide a pinned coupling thereof.

4. The trussed embankment dam and wall structure as recited in claim 1, wherein each cantilever structure includes at least two multidirectional connecting boards and at least one member disposed between the multidirectional connecting boards, each multidirectional connecting board having a plurality of first connecting holes formed through a peripheral portion thereof, an end portion of a respective rod member of a corresponding rod member group being disposed between the two multidirectional connecting boards, the end portion of the respective rod member having a second connecting hole formed therethrough and disposed in correspondence with respective first connecting holes of the multidirectional connecting boards for receiving an upper portion of a respective anchor member to provide a pinned coupling thereof.

5. The trussed embankment dam and wall structure as recited in claim 1, wherein the triangularly shaped closed contours of the truss sections are filled with a soil filler.

6. A trussed embankment dam and wall structure, comprising a plurality of cantilever structures interconnected by a plurality of rod members to form a multiplicity of truss sections; each cantilever structure including (a) at least two multidirectional connecting boards stacked one upon the other, each multidirectional connecting board having a centrally disposed through hole, and (b) an anchor supporting pillar being received in the through holes of the multidirectional connecting boards and extending therefrom to form a pinned joint therewith and a support for the cantilever structure by anchoring a lower portion of the anchor supporting pillar into a stratum or a foundation; each multidirectional connecting board having a plurality of radially directed embedding grooves formed in opposing sides thereof for wedgingly capturing end portions of respective rod members between the multidirectional connecting boards and within correspondingly aligned embedding grooves thereof; each truss section being defined by three cantilever structures joined together by corresponding rod members to form a closed contour having a substantially triangularly shaped structure.

7. The trussed embankment dam and wall structure as recited in claim 6, wherein the triangularly shaped closed contours of the truss sections are filled with a soil filler.

8. A trussed embankment dam and wall structure, comprising a multiplicity of truss sections interconnected by a plurality of rod members; each truss section being defined by three cantilever structures and at least one triangularly shaped frame joining the three cantilever structures together, each of the three cantilever structures being coupled to a respective apex of the triangularly shaped frame, the multiplicity of truss sections being joined together by respective rod members extending between corresponding cantilever structures of adjacent truss sections to form triangularly shaped closed contour truss structures therebetween.

9. The trussed embankment dam and wall structure as recited in claim 8, wherein openings in the truss sections and the triangularly shaped closed contour truss structures between the truss sections are filled with a soil filler.

* * * * *